US011821440B2

(12) United States Patent
Sun et al.

(10) Patent No.: US 11,821,440 B2
(45) Date of Patent: Nov. 21, 2023

(54) VACUUM PUMP, AND CONTROL DEVICE OF VACUUM PUMP

(71) Applicant: Edwards Japan Limited, Chiba (JP)

(72) Inventors: Yanbin Sun, Chiba (JP); Kengo Saegusa, Chiba (JP)

(73) Assignee: Edwards Japan Limited, Chiba (JP)

( * ) Notice: Subject to any disclaimer, the term of this patent is extended or adjusted under 35 U.S.C. 154(b) by 695 days.

(21) Appl. No.: 16/967,892

(22) PCT Filed: Feb. 8, 2019

(86) PCT No.: PCT/JP2019/004745
§ 371 (c)(1),
(2) Date: Aug. 6, 2020

(87) PCT Pub. No.: WO2019/159855
PCT Pub. Date: Aug. 22, 2019

(65) Prior Publication Data

US 2021/0025407 A1 Jan. 28, 2021

(30) Foreign Application Priority Data

Feb. 16, 2018 (JP) ..... 2018-025854

(51) Int. Cl.
*F04D 29/58* (2006.01)
*F28D 9/00* (2006.01)
*F04D 19/04* (2006.01)

(52) U.S. Cl.
CPC ..... *F04D 29/5813* (2013.01); *F28D 9/0081* (2013.01); *F04D 19/042* (2013.01)

(58) Field of Classification Search
CPC ... F04D 29/5813; F04D 19/042; F28D 9/0081
(Continued)

(56) References Cited

U.S. PATENT DOCUMENTS 5,971,725 A * 10/1999 de Simon ..... F04D 25/068 417/423.4
6,755,611 B1 * 6/2004 Kabasawa ..... F04D 17/168 415/90

(Continued)

FOREIGN PATENT DOCUMENTS

CN 2713642 Y 7/2005
EP 2651015 A1 10/2013

(Continued)

OTHER PUBLICATIONS

PCT International Search Report dated May 21, 2019 for corresponding PCT Application No. PCT/JP2019/004744.

(Continued)

*Primary Examiner* — Anatoly Vortman
(74) *Attorney, Agent, or Firm* — Theodore M. Magee; Westman, Champlin & Koehler, P.A.

(57) ABSTRACT

To provide a vacuum pump capable of efficiently cooling electrical equipment. The vacuum pump comprises a pump main body, and an electrical equipment case disposed outside the pump main body, wherein the electrical equipment case includes a cooling jacket in which a cooling medium flow passage is formed, and a power supply circuit portion that has a circuit component and can be cooled by the cooling jacket, the power supply circuit portion being attached to the cooling jacket so that heat from the electrical component portion can be transferred, and the cooling jacket includes a jacket main body and a cooling pipe for circulating cooling water in the jacket main body, and partially exposes the cooling pipe toward the power supply circuit portion.

4 Claims, 2 Drawing Sheets

(58) Field of Classification Search
USPC ..... 361/689
See application file for complete search history.

(56) References Cited

U.S. PATENT DOCUMENTS

| | | | | |
|---|---|---|---|---|
| 7,106,595 | B2 * | 9/2006 | Foster, Sr. | G06F 1/20 361/721 |
| 7,393,228 | B2 * | 7/2008 | Kabasawa | F04D 19/04 439/247 |
| 7,572,096 | B2 * | 8/2009 | Nonaka | F04D 19/04 415/200 |
| 7,753,661 | B2 * | 7/2010 | Okudera | F04D 19/042 417/423.4 |
| 7,755,897 | B2 * | 7/2010 | Chen | H01L 23/427 361/728 |
| 7,957,134 | B2 * | 6/2011 | Farnsworth | H01L 23/427 361/679.52 |
| 7,993,113 | B2 * | 8/2011 | Namiki | F04D 29/601 417/423.4 |
| 8,366,380 | B2 * | 2/2013 | Sakaguchi | F04D 19/042 416/198 A |
| 8,651,838 | B2 * | 2/2014 | Birkenstock | F04D 29/083 417/423.4 |
| 8,690,525 | B2 * | 4/2014 | Ohtachi | F04D 27/0292 415/118 |
| 8,961,105 | B2 * | 2/2015 | Kogame | F04D 19/04 415/55.1 |
| 9,245,820 | B2 * | 1/2016 | Goldrian | H01L 23/473 |
| 9,267,392 | B2 * | 2/2016 | Schroder | F01D 25/00 |
| 9,534,506 | B2 * | 1/2017 | Okudera | F04D 29/644 |
| 9,964,112 | B2 * | 5/2018 | Yamato | F04D 29/706 |
| 10,001,126 | B2 * | 6/2018 | Miwata | F04D 27/001 |
| 10,233,943 | B2 * | 3/2019 | Moriyama | F04D 29/058 |
| 10,760,578 | B2 * | 9/2020 | Shiba | F04D 25/068 |
| 2005/0276021 | A1 * | 12/2005 | Gates | H01L 23/3672 361/709 |
| 2007/0201208 | A1 * | 8/2007 | Goodwin | G06F 1/20 257/E23.098 |
| 2013/0189090 | A1 * | 7/2013 | Okudera | F01D 25/24 415/182.1 |
| 2015/0257249 | A1 | 9/2015 | Kim | |
| 2016/0195098 | A1 * | 7/2016 | Omori | F04D 19/042 417/423.7 |
| 2018/0254685 | A1 * | 9/2018 | Seki | F04C 13/001 |
| 2019/0242386 | A1 * | 8/2019 | Shimizu | F04D 19/044 |
| 2019/0277296 | A1 * | 9/2019 | Okada | H05K 7/14 |
| 2021/0025407 | A1 * | 1/2021 | Sun | F04B 39/121 |

FOREIGN PATENT DOCUMENTS

| | | | |
|---|---|---|---|
| EP | 3232543 | A1 | 10/2017 |
| JP | H07194139 | A | 7/1995 |
| JP | 2008244062 | A | 10/2008 |
| JP | 2009270750 | A | 11/2009 |
| JP | 2011112254 | A | 6/2011 |
| JP | 2013100760 | A | 5/2013 |
| JP | 2014043827 | A | 3/2014 |
| JP | 2017153339 | A | 8/2017 |
| JP | 2017200314 | A | 11/2017 |
| WO | 2011111209 | A1 | 9/2011 |
| WO | 2012053271 | A1 | 4/2012 |
| WO | 2019159854 | A1 | 8/2019 |

OTHER PUBLICATIONS

PCT International Written Opinion dated May 21, 2019 for corresponding PCT Application No. PCT/JP2019/004744.
PCT International Search Report dated May 21, 2019 for corresponding PCT Application No. PCT/JP2019/004745.
PCT International Written Opinion dated May 21, 2019 for corresponding PCT Application No. PCT/JP2019/004745.
European Communication dated Oct. 11, 2021 and Supplementary European Search Report dated Oct. 1, 2021.

* cited by examiner

VACUUM PUMP, AND CONTROL DEVICE OF VACUUM PUMP

CROSS-REFERENCE OF RELATED APPLICATION

This application is a Section 371 National Stage Application of International Application No. PCT/JP2019/004745, filed Feb. 2, 2019, which is incorporated by reference in its entirety and published as WO 2019/159855 A1 on Aug. 22, 2019 and which claims priority of Japanese Application No. 2018-025854, filed Feb. 16, 2018.

BACKGROUND

The present invention relates to a vacuum pump such as a turbomolecular pump, and a control device of the vacuum pump.

The turbomolecular pump device disclosed in, for example, WO 2011/111209, has conventionally been known. The turbomolecular pump device of WO 2011/111209 is provided with cooling devices 13 as described in paragraph 0010 and shown in FIGS. 1, 2, and the like. The cooling devices 13 are interposed side by side in the axial direction between a pump main body 11 and a power supply apparatus 14, and cool mainly electronic components of a motor drive circuit in the power supply apparatus 14. The cooling devices 13 each have a jacket main body 13a in which a cooling water passage is formed, and a cooling water inlet 13b and a cooling water outlet 13c for circulating cooling water in the cooling water passage by means of a water-feeding pump.

The discussion above is merely provided for general background information and is not intended to be used as an aid in determining the scope of the claimed subject matter. The claimed subject matter is not limited to implementations that solve any or all disadvantages noted in the background.

SUMMARY

Incidentally, vacuum pumps such as turbomolecular pumps need to be downsized for reasons such as the surrounding space of the vacuum equipment to be connected. In some cases, electrical equipment such as motor drive circuits and control circuits need to be downsized as well, and in such a case, the mounting density of the electrical equipment increases easily, thereby raising the temperatures of the electrical equipment. The mounting density of the electrical equipment is increased also by improved performance of the vacuum pump, thereby easily increasing the temperatures of the electrical equipment. For this reason, even when the cooling devices disclosed in, for example, WO 2011/111209 are used, cooling needs to be performed as efficient as possible. Efficient cooling can extend the life of the electrical equipment.

In order to enhance the cooling effect, air cooling using, for example, a cooling fan in place of the water cooling described in WO 2011/111209 is considered. However, the external dimensions of the vacuum pump increase by providing the cooling fan, making downsizing of the vacuum pump difficult. Moreover, use of the cooling fan causes the generated air flow to raise dust in the clean room, making it difficult to maintain the clean environment. In addition, when the cooling fan is used, intensive use of an air conditioner to eliminate the raised dust may result in an increase of the total energy consumption. For these reasons, it is difficult to employ air cooling to achieve efficient cooling in a vacuum pump such as a turbomolecular pump; thus, it is desired that water cooling be employed.

The present invention was contrived in order to solve the foregoing problems, and an object thereof is to provide a vacuum pump capable of efficiently cooling electrical equipment, and a control device of the vacuum pump.

In order to achieve the object described above, the present invention provides a vacuum pump comprising a pump main body, and a control device disposed outside the pump main body, wherein the control device includes a cooling portion in which a cooling medium flow passage is formed, and an electrical component portion that has a heat generating component and can be cooled by the cooling portion, the electrical component portion is attached to the cooling portion so that heat from the electrical component portion can be transferred, the electrical component portion is provided with a circuit board that has the heat generating component mounted thereon and is fixed to the cooling portion, and a mold portion that at least partially covers the circuit board and the heat generating component, and the heat can be transferred toward the cooling portion via the mold portion.

In order to achieve the object described above, the present invention according to another aspect is a vacuum pump in which a penetrating portion that penetrates the circuit board and into which the mold portion enters is formed in the circuit board, and the heat can be transferred toward the cooling portion via the mold portion and the penetrating portion.

In order to achieve the object described above, the present invention according to another aspect is a vacuum pump in which the cooling portion faces the mold portion entering the penetrating portion, at a position opposite to a side of the circuit board on which the heat generating component is mounted.

In order to achieve the object described above, the present invention according to another aspect is a vacuum pump in which the cooling portion partially exposes the cooling medium flow passage toward the electrical component portion.

In order to achieve the object described above, the present invention according to another aspect is a control device of a vacuum pump, comprising a cooling portion in which a cooling medium flow passage is formed, and an electrical component portion that has a heat generating component and can be cooled by the cooling portion, wherein the electrical component portion is attached to the cooling portion so that heat from the electrical component portion can be transferred, the electrical component portion is provided with a circuit board that has the heat generating component mounted thereon and is fixed to the cooling portion, and a mold portion that at least partially covers the circuit board and the heat generating component, and the heat can be transferred toward the cooling portion via the mold portion.

The present invention can provide a vacuum pump capable of efficiently cooling electrical equipment, and a control device of the vacuum pump.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Figure 1A:
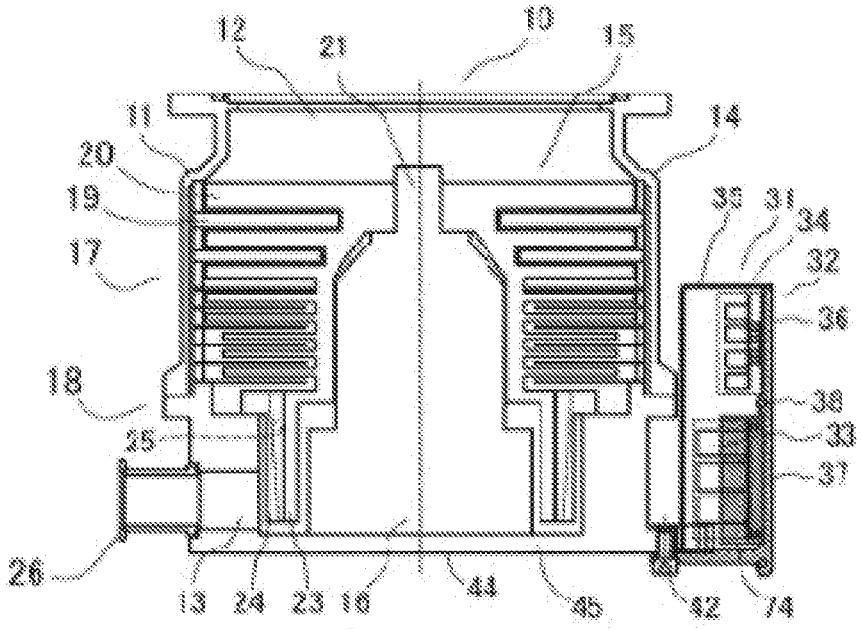
FIG. 1A is a cross-sectional diagram schematically showing a turbomolecular pump according to one embodiment of the present invention.

A vacuum pump according to one embodiment of the present invention is now described hereinafter with reference to the drawings. FIG. 1A schematically shows a vertical cross section of a turbomolecular pump 10 as the vacuum pump, wherein part of the vacuum pump is omitted. The turbomolecular pump 10 is connected to a vacuum chamber (not shown) of a target device such as a semiconductor manufacturing device, an electron microscope, or a mass spectrometer.

The turbomolecular pump 10 integrally has a cylindrical pump main body 11 and a box-shaped electrical equipment case 31 as an electrical equipment storage (control device). The pump main body 11 has an inlet portion 12 on the upper side in the drawing which is connected to a side of the target device, and an exhaust portion 13 on the lower side which is connected to an auxiliary pump or the like. The turbomolecular pump 10 can be used not only in a vertical posture in the vertical direction as shown in FIG. 1A, but also in an inverted posture, a horizontal posture, and an inclined posture.

The electrical equipment case 31 is attached to an outer peripheral surface, which is a side portion of the pump main body 11, in such a manner as to protrude in a radial direction. Thus, the turbomolecular pump 10 of the present embodiment is downsized in the axial direction as compared to the type disclosed in, for example, WO 2011/111209 in which the pump main body and the electrical equipment (electrical component) are arranged in the axial direction (gas transfer direction). Furthermore, the turbomolecular pump 10 of the present embodiment can be installed even if an axial space is relatively narrow.

The pump main body 11 has a cylindrical main body casing 14 with steps. In the present embodiment, the main body casing 14 has a diameter of approximately 350 mm and a height of approximately 400 mm. The inside of the main body casing 14 is provided with an exhaust mechanism portion 15 and a rotary drive portion 16. The exhaust mechanism portion 15 is of a composite type composed of a turbomolecular pump mechanism portion 17 and a thread groove pump mechanism portion 18.

The turbomolecular pump mechanism portion 17 and the thread groove pump mechanism portion 18 are disposed in a continuous fashion in the axial direction of the pump main body 11; in FIG. 1A, the turbomolecular pump mechanism portion 17 is disposed on the upper side in the drawing and the thread groove pump mechanism portion 18 is disposed on the lower side in the drawing. General structures can be employed as basic structures of the turbomolecular pump mechanism portion 17 and the thread groove pump mechanism portion 18; the basic structures are schematically described hereinafter.

The turbomolecular pump mechanism portion 17 disposed on the upper side in FIG. 1A transfers gas by means of a large number of turbine blades, and includes a stator blade portion 19 and a rotor blade portion 20 that each have a predetermined inclination or curved surface and are formed radially. In the turbomolecular pump mechanism portion 17, stator blades and rotor blades are arranged alternately in dozens of stages, but the illustration of reference numerals for the stator blades and the rotor blades are omitted in order to prevent the drawing from becoming complicated. In FIG. 1A, the illustration of hatching showing the cross sections of components in the pump main body 11 are omitted as well, in order to prevent the drawing from becoming complicated.

The stator blade portion 19 is provided integrally on the main body casing 14, and the rotor blades provided in the rotor blade portion 20 are each sandwiched between upper and lower stator blades provided in the stator blade portion 19. The rotor blade portion 20 is integrated with a rotating shaft (rotor shaft) 21, only an upper end of which is schematically shown in FIG. 1A.

The rotating shaft 21 passes through the thread groove pump mechanism portion 18 on the lower side and is coupled to the abovementioned rotary drive portion 16, only the outline of which is schematically shown in the drawing. The thread groove pump mechanism portion 18 includes a rotor cylindrical portion 23 and a thread stator 24, wherein a thread groove portion 25, which is a predetermined gap, is formed between the rotor cylindrical portion 23 and the thread stator 24. The rotor cylindrical portion 23 is coupled to the rotating shaft 21 so as to be able to rotate integrally with the rotating shaft 21. An outlet port 26 to be connected to an exhaust pipe is disposed below the thread groove pump mechanism portion 18, whereby the inside of the outlet port 26 and the thread groove portion 25 are spatially connected.

The rotary drive portion 16 is a motor and includes, although not shown, a rotor formed on an outer periphery of the rotating shaft 21 and a stator disposed so as to surround the rotor. The power for activating the rotary drive portion 16 is supplied by power supply equipment or control equipment stored in the electrical equipment case 31 described above.

Although not shown, a non-contact type bearing by magnetic levitation (magnetic bearing) is used to support the rotating shaft 21. Therefore, the pump body 11 can realize an environment in which the pump is not worn when rotated at high speed, has a long life, and does not require lubricating oil. A combination of a radial magnetic bearing and a thrust bearing can be employed as the magnetic bearing. Further, the magnetic bearing can be used in combination with a touchdown bearing to prevent possible damage.

Driving the rotary drive portion 16 rotates the rotor blade portion 20 and the rotor cylindrical portion 23 of the turbomolecular pump mechanism portion 17 that are integrated with the rotating shaft 21. When the rotor blade portion 20 is rotated, the gas is drawn from the inlet portion 12 shown on the upper side of FIG. A, and transferred toward the thread groove pump mechanism portion 18 while causing gas molecules to collide with the stator blades of the stator blade portion 19 and the rotor blades of the rotor blade portion 20. In the thread groove pump mechanism portion 18, the gas transferred from the turbomolecular pump mechanism portion 17 is introduced to the gap between the rotor cylindrical portion 23 and the thread stator 24 and compressed in the thread groove portion 25. The gas compressed inside the thread groove portion 25 enters the outlet port 26 from the exhaust portion 13 and is then exhausted from the pump main body 11 via the outlet port 26.

Figure 1B:
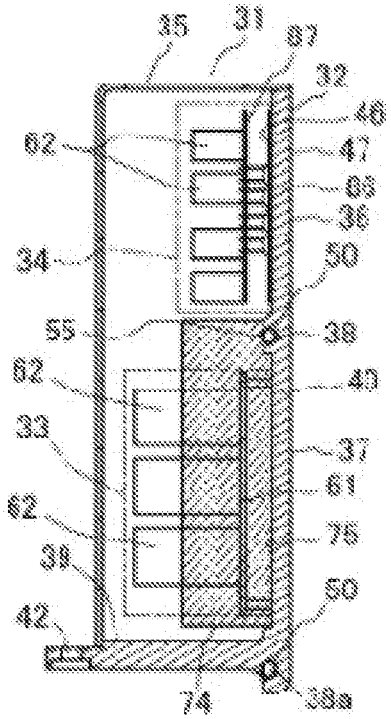
FIG. 1B is a cross-sectional diagram showing an enlargement of an electrical box.

The electrical equipment case 31 is described next. As shown in FIG. 1B, a power supply circuit portion 33 as an electrical equipment portion (electrical component portion)

and a control circuit portion 34 also as an electrical equipment portion are stored in a rectangular box-shaped box casing 32 of the electrical equipment case 31. The box casing 32 is configured by combining and joining a sheet metal casing panel 35 having an L-shaped cross section, a cooling jacket 36 as a cooling portion also having an L-shaped cross section, and the like. Note that in FIG. 1A, end closing panels closing both ends of the casing panel 35 (both ends in the direction perpendicular to the page space) are removed so that the inside of the electrical equipment case 31 can be seen. Two rectangular panel members, for example, can be used as the end closing panels.

The cooling jacket 36 includes a jacket main body 37 and a cooling pipe 38. The jacket main body 37 is a casting that integrally includes a horizontal portion 39 oriented substantially horizontally and a vertical portion 40 oriented substantially vertically. Aluminum or the like can be employed as the material (casting material) of the cooling jacket 36. The horizontal portion 39 has a base end side thereof connected to the vertical portion 40 and facing outside the pump main body 11 (so as to be away from the pump main body 11) and has a tip end side facing the pump main body 11.

Figure 2A:
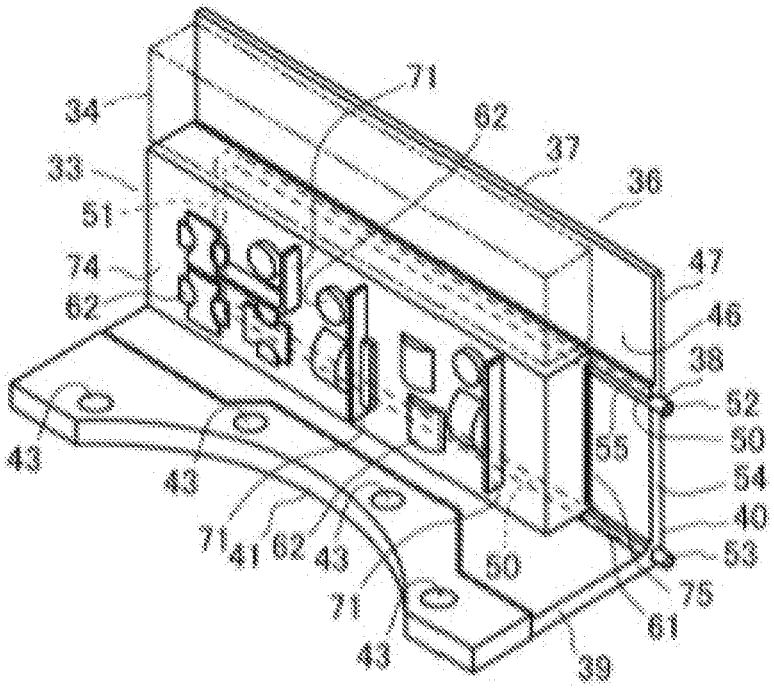
FIG. 2A is a perspective view schematically showing the cooling jacket and a power supply circuit portion.

Furthermore, as shown in FIG. 2A, the tip end side of the horizontal portion 39 is cut into an arc shape to match an outer diameter of the pump main body 11, and is provided with a plurality of through holes 43 along the resultant arc-shaped tip end portion 41 to allow the passage of hexagon socket head bolts 42 (only one is shown in FIG. 1A). Also, as shown in FIG. 1A, the tip end side of the horizontal portion 39 is disposed in such a manner as to overlap with a lower surface 44 of the main body casing 14, and is bolted, from below, to a lower flange 45 of the pump main body 11 by the plurality of hexagon socket head bolts 42.

As shown in FIG. 2A, the vertical portion 40 includes an inner surface 46 as a cooling surface facing the pump main body 11, and an outer surface 47 also as a cooling surface facing outside. On the inner surface 46, the power supply circuit portion 33 and the control circuit portion 34 described above are arranged vertically, with the power supply circuit portion 33 disposed below. The power supply circuit portion 33 and the control circuit portion 34 are fixed to the vertical portion 40 by means of bolting or the like in such a manner that the heat can be transferred.

However, the arrangement of the power supply circuit portion 33 and the control circuit portion 34 is not limited to the arrangement described above; the power supply circuit portion 33 and the control circuit portion 34 may be arranged vertically, with the control circuit portion 34 disposed below.

FIGS. 1A and 1B schematically show the power supply circuit portion 33 and the control circuit portion 34 surrounded by two-dot chain lines. Moreover, the power supply circuit portion 33 is sealed with a mold resin 74 functioning as a mold portion, as shown in FIGS. 1B and 2A. In FIG. 1B, the mold resin 74 is hatched with a two-dot chain line to make the range of the mold resin 74 clear, and specific configurations of the power supply circuit portion 33 and the mold resin 74 are described hereinafter.

As shown in FIG. 2A, the cooling pipe 38 described above is inserted (insert casting) into the vertical portion 40 of the cooling jacket 36. The cooling pipe 38 is for cooling the inside of the electrical equipment case 31, wherein cooling water (cooling medium, refrigerant) supplied from the outside circulates through a cooling medium flow passage 38*a* provided in the cooling pipe 38. The diameter of the cooling pipe 38 is, for example, approximately several mm, and stainless steel (SUS), copper or the like can be employed as the material of the cooling pipe 38.

The cooling pipe 38 is bent into a C-shape in the vertical portion 40 as shown by a broken line, and includes parallel portions 50 extending substantially horizontally and parallel to each other, and a vertical connecting portion 51 connecting the parallel portions 50. Both ends 52, 53 of the cooling pipe 38 slightly protrude approximately several mm from an end surface 54 of the vertical portion 40.

In the present embodiment, of the both ends 52, 53 of the cooling pipe 38, the end 53 on the lower side in FIG. 2A (on the horizontal portion 39 side) serves as an inlet for the cooling water (cooling medium, refrigerant), and the end 52 on the upper side serves as an outlet for the cooling water. However, the flow directions of the cooling water are not limited to the ones described above; the end 52 on the upper side may serve as the inlet, and the end 53 on the lower side may serve as the outlet. In addition, although not shown, a pipe joint can be connected to the ends 52, 53 of the cooling pipe 38, to connect the ends 52, 53 to a cooling water circulation path through the joint.

Moreover, the cooling pipe 38 is partially exposed from the inner surface 46 of the vertical portion 40, and a part of the cooling pipe 38 in a circumferential direction thereof is configured as an exposed portion 55 protruding from the inner surface 46. The exposed portion 55 is located behind the power supply circuit portion 33 fixed to the inner surface 46, is in contact with the mold resin 74, and is separated from the power supply circuit portion 33. In the present embodiment, only the parallel portion 50 on the upper side of FIG. 2A and the connecting portion 51 configure the exposed portion 55. However, the configuration is not limited thereto; the exposed portion 55 can be configured by substantially the entire length of the cooling pipe 38 in a longitudinal direction thereof.

The cooling portion is generally cooled by the cooling water flowing through the cooling pipe 38. However, the cooling medium (refrigerant) is not limited to the cooling water; a fluid other than water or other cooling medium such as a cold gas may be used.

In the present embodiment, the exposed portion 55 and the inner surface 46 of the vertical portion 40 are in contact with the mold resin 74, but the configuration is not limited thereto; for example, a gap (space) of a predetermined distance can be interposed partially or entirely between the inner surface 46 of the vertical portion 40 and the mold resin 74.

Figure 1C:
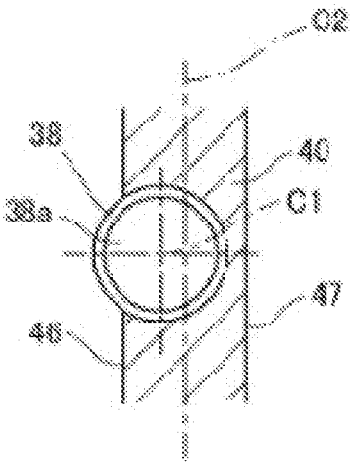
FIG. 1C is an explanatory diagram showing the positional relationship between a vertical portion and a cooling pipe of a cooling jacket.

FIG. 1C shows the positional relationship between the cooling pipe 38 and the vertical portion 40. In the diagram, a shaft center C1 of the cooling pipe 38 and a centerline C2 of the vertical portion 40 in the thickness direction thereof are separated from each other in the horizontal direction, and the cooling pipe 38 is eccentric with respect to the vertical portion 40. Most of the cooling pipe 38 is covered by the vertical portion 40 by means of insert casting while in tight contact with the material of the vertical portion 40 (aluminum which is a casting material), without a gap therebetween. In order to form the exposed portion 55, when casting the jacket main body 37, the casting can be performed after the cooling pipe 38 is disposed in such a manner that the shaft center C becomes eccentric with respect to the centerline C2 of the vertical portion 40 in the thickness direction thereof.

The configuration is not limited thereto; when casting the jacket main body 37, the cooling pipe 38 may be disposed so as to be fit in the vertical portion 40 over the entire circumference, then the casting may be performed, and thereafter the inner surface 46 may be cut so that the exposed portion 55 appears. However, it is conceivable that, in a case where the vertical portion 40 is relatively thin, and the cooling pipe 38 and the outer surface 47 are not thick enough, the cooling pipe 38 easily separates from the vertical portion 40 due to a load acting on the vertical portion 40 during cutting. In such a case, it is assumed that it is difficult to adjust the level of the load applied during cutting. For this reason, as illustrated in FIG. 1C, when casting, it is desirable that insert casting be performed in the state in which the cooling pipe 38 is eccentric with respect to the vertical portion 40.

Figure 2B:
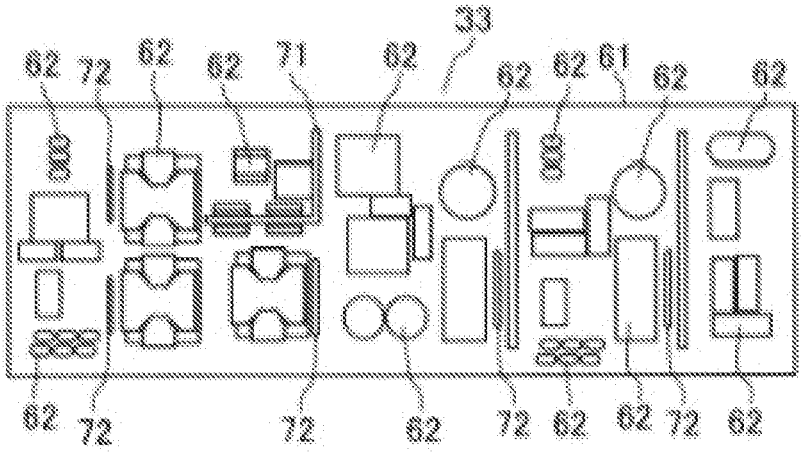
FIG. 2B is a front view schematically showing a circuit board of the power supply circuit portion.

Next, the power supply circuit portion 33 is described on the basis of FIGS. 2A and 2B. FIG. 2A shows a state obtained after the mold resin 74 is formed, and FIG. 2B shows a state obtained before the mold resin 74 is formed. As shown in FIG. 2B, the power supply circuit portion 33 has a circuit board 61, wherein circuit components (electrical components and electronic components) 62 for driving the pump main body 11 are mounted on the circuit board 61. A typical epoxy substrate or the like can be employed as the circuit board 61. The circuit board 61 is fixed to the vertical portion 40 by, for example, bolting four corners of the circuit board 61.

Examples of the circuit components 62 include transformers, coils, capacitors, filters, diodes, field effect transistors (FETs), and the like. FIGS. 2A and 2B show the circuit components 62 (not shown) in more detail than FIGS. 1A and 1B. These circuit components 62 can be heat generating components, depending on the characteristics thereof. Heat generated by the circuit components 62 moves to the circuit board 61 or surroundings thereof to raise the temperature around the circuit board 61. Part of the heat generated in the circuit board 61 moves toward the cooling jacket 36 via the bolts (not shown) used for joining the circuit board 61 to the vertical portion 40 or via the mold resin 74 which is described hereinafter.

Here, when mounting various circuit components 62 onto the circuit board 61, the directions (or "postures") of the circuit components 62 are determined in view of the heights thereof. In other words, although the cooling jacket 36 is positioned on the back side of the circuit board 61 (the non-mounting side) as described above, the circuit components 62 become far away from the cooling jacket 36 as the heights of the circuit components 62 increase on the mounting side of the circuit board 61. Mounting the circuit components 62 having large heights (i.e., tall circuit components 62) upright makes it difficult to transfer heat to the cooling jacket 36 by heat conduction or heat transmission, and as a result the power supply circuit portion 33 cannot be cooled easily.

Therefore, in the present embodiment, the circuit components 62 are laid out on the circuit board 61, at sections where a necessary area can be secured. In such a state in which the circuit components 62 are laid out, the heights thereof from the circuit board 61 can be reduced, and this state can be referred to as "tilted state" or the like. By laying the circuit components 62 so that a larger portion of the circuit components 62 comes close to the cooling jacket 36, the circuit components 62 can be cooled efficiently.

Furthermore, a plurality of sheet metal members 71 made of metal are mounted on the circuit board 61. The sheet metal members 71 can be fixed by providing the circuit board 61 with a member for supporting the sheet metal members 71 or by providing the sheet metal members 71 with ribs for screwing the sheet metal members 71. Aluminum or the like, for example, is used as the material of the sheet metal members 71.

The sheet metal members 71 may be in a flat shape or an L-shape and are fixed to the circuit board 61 so as to stand upright substantially perpendicularly from the circuit board 61 (in an upright posture). The sheet metal members 71 have the thickness direction thereof oriented in a direction in which a mounting surface of the circuit board 61 extends (a direction perpendicular to the thickness direction of the circuit board 61). Mounting the sheet metal members 71 in this orientation can minimize the area occupied by the sheet metal members 71 on the mounting surface of the circuit board 61.

In addition, the sheet metal members 71 can be used for mounting the circuit components 62. Of the various circuit components 62, diodes and other semiconductor elements that tend to increase in temperature are fixed to plate surfaces of the sheet metal members 71. Conduction of the semiconductor elements can be ensured by connecting lead portions (not shown) of the semiconductor elements fixed to the sheet metal members 71 to wiring of the circuit board 61. Providing the circuit components 62 on the plate surfaces of the sheet metal members 71 in this manner can increase the area on the circuit board 61 on which the circuit components 62 can be mounted.

As shown in FIG. 2B, slits 72 that function as a plurality of penetrating portions formed in the shape of a long hole are formed in the circuit board 61. These slits 72 are formed at predetermined positions on the circuit board 61 and penetrate the circuit board 61. In the present embodiment, the slits 72 are formed at sections that are separated from some of the sheet metal members 71 or predetermined circuit components 62 only by a predetermined distance (e.g., approximately 1 mm to several mm).

The mounting surface of the circuit board 61 and the rear surface side of the same which is the non-mounting side are spatially connected via the slits 72, allowing the heat passing through the slits 72 to move between the mounting surface and the rear surface of the circuit board 61. The larger the opening areas of the slits 72, the easier for the heat to move. Moreover, in the present embodiment, the holes penetrating the circuit board 61 are configured as the long-hole slits 72. However, the shape of the slits 72 is not limited thereto; for example, the slits 72 can have various shapes such as a rectangular shape, a square shape, a circular shape, a triangular shape, a diamond shape, and a trapezoidal shape. The locations of the holes penetrating the circuit board 61 are not limited to the vicinity of the circuit components 62 (including the sheet metal members 71); the holes can be arranged, for example, immediately below the circuit components 62 or positions intersecting with the circuit components 62.

Also, the circuit board 61 is sealed with the mold resin 74 as described above. As shown in FIG. 2A, the mold resin 74 is shaped into a rectangular box and is in close contact with the circuit components 62 (including the sheet metal members 71) of the circuit board 61 without a gap therebetween. Furthermore, the mold resin 74 covers a region up to a predetermined height with reference to the mounting surface of the circuit board 61, and only upper ends of relatively tall electronic components protrude from the mold resin 74. In the present embodiment, epoxy resin is used as the mold resin 74, but the material of the mold resin 74 is not limited to epoxy resin; a resin such as silicon can be used.

The mold resin 74 is configured to fulfill the function of improving the insulation with respect to the circuit board 61, the drip-proof function, the waterproof function, and the like. The mold resin 74 also functions to cool the power supply circuit portion 33 by coming into contact with the various circuit components 62 and the circuit board 61 and entering the slits 72 described above. Specifically, the mold resin 74 not only removes the heat from the various circuit components 62 and the circuit board 61 but also transfers part of the removed heat to the rear surface side of the circuit board 61 via the slits 72.

In addition, in the present embodiment, the gap between the circuit board 61 and the vertical portion 40 of the cooling jacket 36 or the exposed portion 55 of the cooling pipe 38 is filled. Therefore, the heat reaching the rear surface side of the circuit board 61 can further be transferred toward the cooling jacket 36 via the mold resin 74. By sufficient cooling, a space not filled with the mold resin 74 can be formed between the circuit board 61 and the cooling jacket 36, and the heat can be transferred through the space facing the cooling jacket 36.

The control circuit portion 34 is described next. The control circuit portion 34 is for controlling the mechanisms such as the motor provided in the pump main body 11. As shown in FIGS. 1B and 2A, the control circuit portion 34 is disposed above the power supply circuit portion 33 in the inner surface 46 of the vertical portion 40 of the cooling jacket 36. In FIG. 2A, the control circuit portion 34 is schematically shown as a rectangular box with a two-dot chain line.

Further, the control circuit portion 34 of the present embodiment has a two-layer laminate structure and includes a metal substrate (aluminum substrate) 86 bolted to the cooling jacket 36, and a resin substrate (glass epoxy substrate or the like) 87 conductively connected to the metal substrate 86. Although not shown, in addition to the circuit components 62, connectors and the like in accordance with various standards are mounted on, for example, the resin substrate 87.

In the present embodiment, since the control circuit portion 34 generates less heat compared with the power supply circuit portion 33, resin sealing as in the power supply circuit portion 33 is not performed on the control circuit portion 34. However, if necessary, the control circuit portion 34 may be resin-sealed except for connection terminals of the connectors.

The heat generated by the control circuit portion 34 is transferred not only from the metal substrate 86 joined to the outer surface 47 of the vertical portion 40, but also from a part that is not in direct contact with the vertical portion 40 (such as the resin substrate 87), to the vertical portion 40 via the metal substrate 86.

According to the turbomolecular pump 10 of the present embodiment described above, the cooling pipe 38 of the cooling jacket 36 is provided in such a manner that the exposed portion 55 is exposed from the vertical portion 40. Accordingly, the space outside the exposed portion 55 and the part that is in contact with the exposed portion 55 can be cooled directly. In addition, the inner surface 46 of the vertical portion 40 can be cooled efficiently.

Therefore, efficient cooling can be achieved without using a cooling fan. Since a cooling fan is not used, the turbomolecular pump 10 can be downsized. Moreover, not only is it possible to suppress an increase in temperature of the electrical equipment case 31, but also the product life of the turbomolecular pump 10 can be increased. Since efficient cooling can be achieved, the temperature of the cooling water does not need to be lowered much in the preceding stage of the turbomolecular pump 10.

Since the protruding, exposed portion 55 is formed, more direct cooling can be achieved as compared with the case where the cooling pipe 38 is entirely covered with the material (casting material) of the vertical portion 40. Furthermore, since the inner surface 46 of the vertical portion 40 can be brought close to the shaft center C1 of the cooling pipe 38, the temperature of the inner surface 46 can easily be lowered. Moreover, the vertical portion 40 can be made thin, reducing the space and weight of the cooling jacket 36. In addition, the amount of casting material used when manufacturing the cooling jacket 36 can be reduced, thereby lowering the manufacturing cost.

Since the cooling pipe 38 is incorporated in the cooling jacket 36 by means of casting, an outer peripheral surface of the cooling pipe 38 and the jacket main body 37 can be brought into close contact with each other at low cost. Specifically, in a case where, for example, the jacket main body 37 is produced by scraping an aluminum material and then the cooling pipe 38 is fixed to this produced jacket main body 37, a gap is likely to be created between the jacket main body 37 and the cooling pipe 38, increasing the thermal resistance. In order to perform efficient cooling, a sheet or the like made of a material having high thermal conductivity needs to be interposed between the jacket main body 37 and the cooling pipe 38 to fill the gap, which results in a cost increase. However, by incorporating the cooling pipe 38 by means of casting as described in the present embodiment, the outer peripheral surface of the cooling pipe 38 and the jacket main body 37 can be brought into close contact with each other at low cost.

According to the turbomolecular pump 10 of the present embodiment, since the power supply circuit portion 33 is sealed with the mold resin 74, heat transfer through the mold resin 74 can be achieved. Furthermore, since the slits 72 penetrating the circuit board 61 are provided and the mounting surface and the rear surface (non-mounting surface) of the circuit board 61 are connected by the slits 72, the heat can be released toward the rear surface of the circuit board 61 via the slits 72. In addition, since the rear surface of the circuit board 61 faces the vertical portion 40 of the cooling jacket 36, the heat generated on the mounting surface of the circuit board 61 can be transferred toward the cooling jacket 36 via the mold resin 74 or the slits 72.

In the present embodiment, the mold resin 74 is placed between the circuit board 61 and the cooling jacket 36. Therefore, the heat between the circuit board 61 and the cooling jacket 36 can be transferred via the mold resin 74. For this reason, the heat can be transferred easily as compared with the case where space is provided between the circuit board 61 and the cooling jacket 36.

Note that cooling using the mold resin 74, the slits 72 or the like can further enhance the effect of the water cooling by the cooling jacket 36. Also, the cooling described in the present embodiment can be a cooling technique that combines the heat transfer by the mold resin 74 or the slits 72 and the cooling by means of the cooling jacket 36. In addition, the cooling described in the present embodiment can be a cooling technique that combines air cooling and water cooling, since the space inside the electrical equipment case 31 is cooled as well by the cooling jacket 36.

The present invention can be modified in various ways in addition to the modes described above. For example, although the slits 72 are provided in the circuit board 61 in the present embodiment, penetrating portions such as the slits 72 may be provided on the sheet metal members 71 to allow the entry of the mold resin 74, so that the heat can be transferred through the penetrating portions on the front and back of the sheet metal members 71.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a pump main body; and a control device disposed outside the pump main body, wherein the control device includes a cooling portion in which a cooling medium flow passage is formed, and an electrical component portion that has a heat generating component and is capable of being cooled by the cooling portion, the electrical component portion is attached to the cooling portion so that heat from the electrical component portion be transferable, the electrical component portion is provided with a circuit board that has the heat generating component mounted thereon and is fixed to the cooling portion, and a mold portion that at least partially covers the circuit board and the heat generating component, the heat is transferable toward the cooling portion via the mold portion, the cooling medium flow passage is formed inside of a cooling pipe casted into the cooling portion, the cooling pipe has an exposed portion which is partially exposed from the cooling portion to the electrical component portion side, and the mold portion is in contact with the exposed portion.

2. The vacuum pump according to claim 1, wherein a penetrating portion that penetrates the circuit board and which the mold portion enters is formed in the circuit board, and the heat is transferrable toward the cooling portion via the mold portion and the penetrating portion.

3. The vacuum pump according to claim 2, wherein the cooling portion faces the mold portion entering the penetrating portion, at a position opposite to a side of the circuit board on which the heat generating component is mounted.

4. A control device of a vacuum pump, comprising:

a cooling portion in which a cooling medium flow passage is formed; and an electrical component portion that has a heat generating component and is capable of being cooled by the cooling portion, wherein the electrical component portion is attached to the cooling portion so that heat from the electrical component portion be transferable, the electrical component portion is provided with a circuit board that has the heat generating component mounted thereon and is fixed to the cooling portion, and a mold portion that at least partially covers the circuit board and the heat generating component, the heat is transferable toward the cooling portion via the mold portion the cooling medium flow passage is formed inside of a cooling pipe casted into the cooling portion, the cooling pipe has an exposed portion which is partially exposed from the cooling portion to the electrical component portion side, and the mold portion is in contact with the exposed portion.

* * * * *